US005484540A

United States Patent [19]

Hubesch

[11] Patent Number: 5,484,540

[45] Date of Patent: Jan. 16, 1996

[54] CONCENTRATED FABRIC SOFTENING COMPOSITIONS

[75] Inventor: Bruno A. J. Hubesch, Tervuren, Belgium

[73] Assignee: The Proctor & Gamble Company, Cincinnati, Ohio

[21] Appl. No.: 178,243

[22] PCT Filed: Jan. 30, 1992

[86] PCT No.: PCT/US92/00661

§ 371 Date: Dec. 10, 1993

§ 102(e) Date: Dec. 10, 1993

[87] PCT Pub. No.: WO92/15745

PCT Pub. Date: Sep. 17, 1992

[30] Foreign Application Priority Data

| | | | |
|---|---|---|---|
| Mar. 8, 1991 | [EP] | European Pat. Off. | 91200507 |
| Jul. 3, 1991 | [EP] | European Pat. Off. | 91870105 |
| Nov. 22, 1991 | [EP] | European Pat. Off. | 91870187 |

[51] Int. Cl.[6] ..... D06M 13/17; D06M 13/352; D06M 13/46

[52] U.S. Cl. ..... 252/8.8; 252/8.6; 252/8.9; 252/174.21

[58] Field of Search ..... 252/8.6, 8.8, 8.9, 252/174.21

[56] References Cited

U.S. PATENT DOCUMENTS

| | | | |
|---|---|---|---|
| 3,962,100 | 6/1976 | Murphy et al. | 252/8.8 |
| 4,025,444 | 5/1977 | Murphy et al. | 252/8.8 |
| 4,140,641 | 2/1979 | Ramachandran | 252/8.75 |
| 4,661,269 | 4/1987 | Trinh et al. | 252/8.8 |
| 4,661,270 | 4/1987 | Grandmaire et al. | 252/8.75 |
| 4,724,089 | 2/1988 | Konig et al. | 252/8.8 |
| 4,806,255 | 2/1989 | Konig et al. | 252/8.8 |
| 4,851,141 | 7/1989 | Demangeon et al. | 252/8.75 |
| 4,933,096 | 6/1990 | Demeyere et al. | 252/8.8 |

FOREIGN PATENT DOCUMENTS

| | | |
|---|---|---|
| 0280550 | 8/1988 | European Pat. Off. . |
| 0345842 | 12/1989 | European Pat. Off. . |
| 0534009 | 3/1993 | European Pat. Off. . |

*Primary Examiner*—Paul Lieberman
*Assistant Examiner*—Michael P. Tierney
*Attorney, Agent, or Firm*—Robert B. Aylor; Betty J. Zea

[57] ABSTRACT

Concentrated fabric softening compositions are described which retain viscosity upon dilution in water. The compositions comprise cationic fabric softening actives, as well as a specific combination of emulsifiers and polymers. The present invention also encompasses a method for the softening of fabrics.

13 Claims, No Drawings

CONCENTRATED FABRIC SOFTENING COMPOSITIONS

TECHNICAL FIELD

The present invention relates to fabric softeners. The compositions according to the invention are concentrated fabric softening compositions which retain viscosity upon dilution.

BACKGROUND

Concentrated fabric softening compositions have been extensively described in the art, and one aspect which has often been discussed is the viscosity of these concentrated compositions; indeed these concentrated compositions are typically extremely viscous and the prior art has often described means by which the viscosity of these concentrated compositions could be controlled or decreased. One aspect which has been much less dealt with is the viscosity of these concentrated compositions upon dilution; indeed it has been observed that the viscosity of such concentrated compositions dramatically drops upon dilution, and this viscosity loss is clearly undesirable, essentially in terms of consumer acceptance.

It is therefore an object of the present invention to provide a concentrated fabric softening composition which has an acceptable viscosity in the concentrated form, and which retains acceptable viscosity after it has been diluted.

This technical problem was discussed in GB 2 007 734 which proposes to use a combination of a fatty quaternary ammonium salt having two long chain alkyl groups together with an oily substance.

Concentrated fabric softeners have been described for instance in EP 56 695, EP 13 780, DE 26 31 114 and EP 60 003, and a process for the preparation of concentrated fabric softening compositions is disclosed in EP-A-316 996.

SUMMARY OF THE INVENTION

It has now been found that the above object can be achieved by formulating a concentrated fabric softening composition comprising from 10% to 35% by weight of a cationic fabric softening active, said composition further comprising:

- from 0.3% to 3% by weight of the composition of a linear fatty alcohol ethoxylate of the formula $RO(Etox)_n$, wherein R is a linear $C_8$–$C_{18}$ alkyl chain, and n representing the weighted average ethoxylation degree is of from 3 to 35, or mixtures thereof;
- from 0.5% to 6% by weight of the total composition of a nonionic hydrophilic polymer, or mixtures thereof;
- from 0% to 2% by weight of the total composition of a highly branched fatty alcohol having from 8 to 18 carbon atoms, or mixtures thereof;
- from 0% to 0.5% by weight of the total composition of a linear or cyclic polydialkylsiloxane of the formula

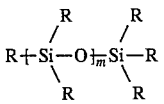

wherein R is a $C_1$–$C_5$ alkyl chain, and m is an integer of from 1 to 500, or mixtures thereof.

The present invention also encompasses a method for the softening of fabrics, wherein the above concentrated compositions are diluted in water before they are contacted with said fabrics in the rinse water.

DETAILED DESCRIPTION OF THE INVENTION

The compositions according to the invention are concentrated fabric softeners; by concentrated, it is meant that the compositions comprise from 10% to 35% by weight of the total composition of a cationic fabric softening active or mixtures thereof, preferably 15% to 25%. By cationic, it is meant any softening compound which is in cationic form in the concentrated softening composition. Suitable cationic fabric softening actives include (i) acylic quaternary ammonium salts having the formula:

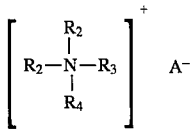

wherein $R_2$ is an acylic aliphatic $C_{15}$–$C_{22}$ hydrocarbon group which may be interrupted by ester groups, $R_3$ is a $C_1$–$C_4$ saturated alkyl or hydroalkyl group, $R_4$ is selected from $R_2$ and $R_3$, and A is an anion; rapidly biodegradable compounds of formula (i) where $R_2$, and possibly $R_4$, are interrupted by ester groups, are disclosed in EPA 239 910;

(ii) diamido quaternary ammonium salts having the formula:

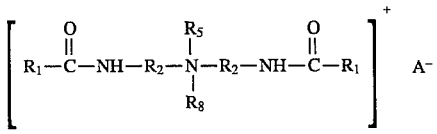

wherein R is an acyclic aliphatic $C_{15}$–$C_{22}$ hydrocarbon group, $R_2$ is a divalent alkylene group having 1 to 3 carbon atoms, $R_5$ and $R_8$ are $C_1$–$C_4$ saturated alkyl or hydroxyalkyl groups, and $A^-$ is an anion:

(iii) diamido alkoxylated quaternary ammonium salts having the formula:

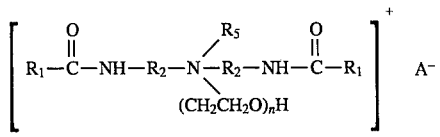

wherein n is an integer of from about 1 to about 5, and $R_1$, $R_2$, $R_5$ and $A^-$ are as defined above.

(iv) quaternary imidazolinium compounds having the formula:

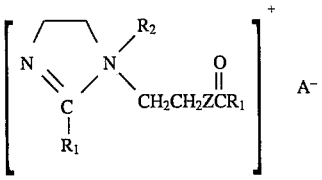

wherein $R_1$=$C_{15}$–$C_{17}$ saturated alkyl, $R_2$=$C_1$–$C_4$ saturated alkyl, Z=NH or O, and $A^-$ is an anion.

Examples of Component (i) are the well-known dialkyldimethylammonium salts such as ditallowdimethylammonium chloride (DTDMAC), ditallowdimethylammonium methylsulfate, di(hydrogenated tallow) dimethylammonium chloride, dibehenyldimethylammonium chloride.

Examples of Component (ii) and (iii) are methylbis(tallowamidoethyl) (2-hydroxyethyl) ammonium methylsulfate and methylbis(hydrogenated tallowamidoethyl) (2-hydroxyethyl) ammonium methylsulfate, wherein $R_1$ is an acyclic aliphatic $C_{15}$–$C_{17}$ hydrocarbon group, $R_2$ is an ethylene group, $R_5$ is a methyl group, $R_8$ is a hydroxyalkyl group and A is a methylsulfate anion; these materials are available from Sherex Chemical Company under the trade names Varisoft 222 R and Varisoft 110 R, respectively.

Examples of Component (iv) are 1-methyl-1-tallowamino-ethyl-2-tallowimidazolinium methylsulfate and 1-methyl-1-(hydrogenated tallowamidoethyl)-methylsulfate.

Other suitable fabric softening actives include the following amines, provided they are present in the concentrated softening composition in a protonated form; such amines are of the formula:

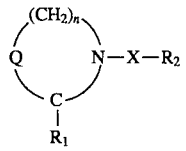

wherein n is 2 or 3, preferably 2; $R_1$ and $R_2$ are, independently, a $C_8$–$C_{30}$ alkyl or alkenyl, preferably $C_{12}$–$C_{20}$ alkyl, more preferably $C_{15}$–$C_{18}$ alkyl, or mixtures of such alkyl radicals. Examples of such mixtures are the alkyl radicals obtained from coconut oil, "soft" (non-hardened) tallow, and hardened tallow. Q is $CH_2$ or N, preferably N, X i

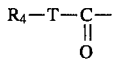

wherein T is O or $NR_5$, $R_5$ being H or $C_1$–$C_4$ alkyl, preferably H, and $R_4$ is a divalent $C_1$–$C_3$ alkylene group or $(C_2H_4O)m$, wherein m is an integer of from 1 to 8; or X is $R_4$.

Most preferred softening agents according to the above formula are imidazolines of the following formula:

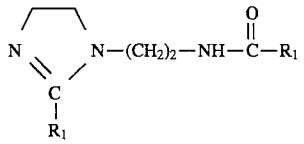

and

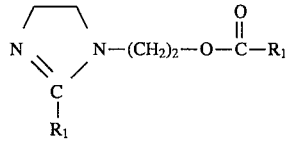

wherein R1 is a tallow group.

The softening amines described herein above are suitable for the purpose of the present invention provided they are present in the concentrated softening composition in a protonated form; a suitable means to protonate these amines is described for instance in EP 199 383.

A preferred softening active mixture for use herein is a mixture of 20% to 70% by weight of the softening active of ditallow dimethyl ammonium chloride (DTDMAC) and 30% to 80% ditallow imidazoline. Preferably, the concentrated compositions according to the invention comprise from 15% to 25% by weight of the finished product of such a mixture.

In an alternative preferred embodiment of the present invention, the softening active comprises a ditallow imidazoline ester such as described herein above (i.e. when T is 0 and $R_1$ and $R_2$ are both tallow in the formula above). This embodiment is particularly preferred for environmental reasons.

The compositions according to the invention further comprise from 0.3% to 3% by weight of the total composition of a linear fatty alcohol ethoxylate of the formula Ro(Etox)n, wherein R is a linear $C_{8-18}$ alkyl chain, and n representing the weighted average ethoxylation degree is of from 3 to 35, or mixtures thereof. Preferred are linear fatty alcohol ethoxylates wherein R is a linear chain having from 10 to 13 carbon atoms, and wherein n is from 5 to 10, preferably 8. Preferably, these compounds, or mixtures thereof are present at levels of from about 1 to about 1.5% by weight of the total composition. These compounds are commercially available from BASF under the trade name LUTENSOL TO®.

The compositions according to the present invention further comprise from 0.5% to 6% , preferably from 1.5% to 2.5% by weight of the composition of a nonionic hydrophylic polymer, or mixtures thereof. Such suitable polymers include polyethylene glycol, polypropylene glycol, polyvinylalcolhol and the like. Particularly preferred is a polyethylene glycol having a molecular weight of from 300 to 50000, preferably 2000 to 10000. In the preferred embodiment herein where the softening active is a mixture of DTDMAC and ditallow imidazoline, it is preferred to use a polyethylene glycol with a molecular weight of about 4000. In the alternative embodiment where the softening active comprises ditallow imidazoline ester, it is preferred to use a polyethylene glycol with a molecular weight of about 8000.

The compositions according to the present invention further comprise from 0% to 2%, preferably from 0% to 0.1% by weight of the total composition of a highly branched fatty alcohol having from 8 to 18 carbon atoms, preferably 12 to 14, or mixtures thereof, most preferably 13. Branched compounds similar to said higly branched fatty alcohols are often present in perfumes; thus, the level of said highly branched fatty alcohol to be added to the composition must be adjusted depending on the perfume which is used, if any. Such highly branched fatty alcohols suitable for use in the compositions according to the present invention are commercially available from EXXON under the trade name EXXAL®.

The compositions according to the present invention further comprise from 0% to 0.5% by weight of the total composition of a linear or cyclic polydialkylsiloxane of the formula:

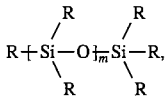

where R is a $C_1$–$C_5$ alkyl group and m is an integer of 1 to 500, or mixtures thereof. Said polydialkylsiloxanes components are not essential ingredients in the compositions according to the invention, as the compositions will retain viscosity upon dilution even in the absence of such polydialkylsiloxanes. However, several benefits can be obtained from these polydialkylsiloxane, including improved stability of the finished product, improved water absorbancy of the treated fabrics. Said polydialkylsiloxanes can also be helpful in avoiding the formation of fabric softener residues which may occur in the dispenser of the washing machine. Thus, preferred compositions according to the present invention comprise from 0.05% to 0.5%, most preferably from 0.1% to 0.3% by weight of the total composition of the above polydialkylsiloxanes, or mixtures thereof. In the compositions according to the present invention where the softening active comprises the ditallow imidazoline ester described herein above, it is preferred to use a polydialkylsiloxane where R is methyl and m is about 200. In other compositions, it is preferred to use a polydialkylsiloxane where R is methyl and m is 7. Suitable polydialkylsiloxanes are commercially available from DOW CORNING under the trade name 200 fluid, and the preferred polydialkylsiloxanes for use herein are DOW CORNING's 200 fluid 350 CS (R is methyl and m is 203) and 5 CS (R is methyl and m is 7).

The compositions according to the invention may additionally comprise such conventional ingredients as perfumes, preservatives, germicides, colorants, fungicides, stabilizers, brighteners, opacifiers and the like, at conventional levels, i.e. up to about 5% by weight of the composition.

The compositions in their concentrated form have a viscosity of from 40 to 400 cps at 60 RPM shear rate. The compositions according to the invention can be used directly in the concentrated form, or they can preferably be diluted before they are used. The compositions according to the present invention are meant to be diluted in water, preferably in 2 to 3 times their weight of water. In diluted form, the compositions have a viscosity of from 20 to 60 cps at 60 RPM shear rate, preferably 0.30 to 50 cps at 60 RPM shear rate.

Thus, the present invention also encompasses a method for the softening of fabrics wherein the concentrated fabric softening compositions described herein above are diluted in water before they are contacted with said fabrics. In a preferred embodiment of said method, a concentrated softening composition as described herein above, which has a viscosity of from 40 to 400 cps at 60 RPM shear rate, is diluted in two times its weight of water so as to obtain a diluted fabric softening composition having a viscosity of from 20 to 60, preferably 30 to 50 cps at 60 RPM shear rate, and said diluted fabric softening composition is contacted with said fabrics in the rinse water.

The compositions according to the present invention are illustrated by the following examples.

EXAMPLE 1

A composition according to the present invention is made, which comprises:

| | |
|---|---|
| Ditallow dimethyl ammonium chloride | 7.60% |
| Ditallow dimethyl imidazoline | 14.20% |
| HCl | 0.82% |
| Polyethylene glycol 4000 MW | 2.00% |
| Silicone oil 5CS | 0.19% |
| Lutensol$^R$ TO8 | 1.30% |
| Exxal$^R$ 13 | 0.08% |
| CaCl2 | 0.20% |
| Perfume | 0.70% |
| waters and minors | to 100% |

silicone oil 5 CS is a polydialkylsiloxane as defined in the description. Lutensol® TO 8 is a linear fatty alcohol ethoxylate, and EXXAL® 13 is a highly branched fatty alcohol, both according to the description hereinbefore.

The above composition was made by adding the HCl to a water seat at 60° C.–65° C. To this solution, a molten permix of ditallow dimethyl ammonium chloride, ditallowimidazoline and Lutensol TO 8 is added at about 80° C.–85° C., under agitation during about 10 minutes. An aqueous solution of $CaCl_2$ is then injected for about 5 minutes. A mixture of perfume and the silicone oil is then added. The composition is then cooled to room temperature. Finally a 50% solution of the polyethylene glycol 4000 MW is added.

The composition thus obtained has a viscosity of about 65 cps before dilution, and 50 cps after dilution in 2 times its weight of water.

EXAMPLE 2

A composition is made which contains:

| | |
|---|---|
| Ditallow imidazoline ester | 22.00% |
| HCl | 1.27% |
| Lutensol ® TO3 | 0.12% |
| Lutensol ® TO5 | 0.24% |
| Lutensol ® TO8 | 1.00% |
| $CaCl_2$ | 0.15% |
| Polyethylene glycol 8000 MW | 2.00% |
| Perfume | 1.06% |
| Water & minors | Balance |

EXAMPLE 3

A composition is made which contains:

| | |
|---|---|
| Ditallow imidazoline ester | 22.00% |
| HCl | 1.27% |
| Lutensol ® TO3 | 0.12% |
| Lutensol ® TO5 | 0.24% |
| Lutensol ® TO8 | 1.00% |
| Exxal ® 13 | 0.06% |
| Dow Corning 200 fluid 350 CS | 0.19% |
| $CaCl_2$ | 0.15% |
| Polyethylene glycol 8000 MW | 2.00% |
| Perfume | 0.90% |
| Water & minors | Balance |

I claim:

1. A concentrated aqueous fabric softening composition comprising from 10% to 35% by weight of a cationic fabric softening active comprising a mixture of ditallow dimethyl ammonium chloride and ditallow imidazoline, said composition further comprising from 0.3% to 3% by weight of the total composition of a linear fatty alcohol ethoxylate of the formula RO(Etox)$_n$, wherein R is a linear $C_8$–$C_{18}$ alkyl chain, and n representing the weighted average ethoxylation degree is of from 8 to 10, or mixtures thereof;

from 0.5% to 6% by weight of the total composition of a nonionic hydrophilic polymer selected from the group consisting of polyethylene glycol having a molecular weight of from 2,000 to 10,000; and from 0 to 0.5% by weight of the total composition of a linear or cyclic polydialkylsiloxane of the formula:

$$R—[—SiR_2—O—]_m—SiR_3$$

wherein R is a $C_1$–$C_5$ alkyl chain, and m is an integer of from 1 to 500, or mixtures thereof.

2. A composition according to claim 1 which comprises from 15% to 25% by weight of the total composition of said cationic fabric softening active, or mixtures thereof.

3. A concentrated fabric softening composition according to claim 1 which consists of from 20% to 70% by weight of said softening active of ditallowdimethyl ammonium chloride and from 30% to 80% by weight of said softening active of ditallow imidazoline.

4. A concentrated fabric softening composition according to claim 1 which comprises from 1.5% to 2.5% by weight of the total composition of a polyethylene glycol having a molecular weight of 4000.

5. A concentrated fabric softening composition according to claim 1 which comprises from 0.05% to 0.5%, preferably by weight of the total composition of said linear or cyclic polydialkylsiloxane of the formula:

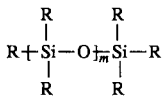

wherein R is methyl, and m is 7.

6. A concentrated fabric softening composition according to claim 1 wherein said softening ditallow imidazoline active comprises ditallow imidazoline ester.

7. A concentrated fabric softening composition according to claim 6 which comprises a polyethylene glycol having a molecular weight of 8000.

8. A concentrated fabric softening composition according to claim 6 which comprises from 0.05% to 0.5%, by weight of the total composition of said linear or cyclic polydialkylsiloxane of the formula:

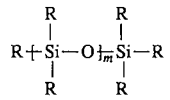

wherein R is a methyl, and m is 203.

9. A concentrated fabric softening composition according to claim 1 which comprises from 1% to 1.5% by weight of the total composition of said fatty alcohol ethoxylate of the formula RO(Etox)n, wherein R is a linear $C_{10}$–$C_{13}$ alkyl chain.

10. A concentrated fabric softening composition according to claim 1, said composition having a viscosity of from 40 to 400 cps at 60 RPM shear rate before dilution, and said composition having a viscosity of from 20 to 60 cps at 60 RPM shear rate after it has been diluted in 2 times its weight of water.

11. A concentrated fabric softening composition according to claim 10 which has a viscosity of from 30 to 50 cps at 60 RPM shear rate after it has been diluted in 2 times its weight of water.

12. A method for the softening of fabrics wherein a concentrated fabric softening composition according to claim 1 and having a viscosity of from 40 to 400 cps at 60 RPM shear rate is diluted in 2 times its weight of water so as to obtain a diluted fabric softening composition having a viscosity of 20 to 60 cps at 60 RPM shear rate, and wherein said diluted fabric softening composition is contacted with said fabrics in rinse water.

13. A method according to claim 12 wherein the concentrated fabric softening composition having a viscosity of from 40 to 400 cps at 60 RPM shear rate is diluted in 2 times its weight of water so as to obtain a diluted fabric softening composition having a viscosity of 30 to 50 cps at 60 RPM shear rate.

* * * * *